United States Patent [19]

Buecheler et al.

[11] Patent Number: 4,615,054

[45] Date of Patent: Oct. 7, 1986

[54] BASKET FOR TOILET BOWL CLEANING BLOCKS

[75] Inventors: Herbert Buecheler, Erkrath; Erich Tuerk, Langenfeld, both of Fed. Rep. of Germany

[73] Assignee: Henkel Kommanditgesellschaft auf Aktien, Duesseldorf, Fed. Rep. of Germany

[21] Appl. No.: 748,527

[22] Filed: Jun. 25, 1985

[30] Foreign Application Priority Data

Jun. 28, 1984 [DE] Fed. Rep. of Germany ..... 3423758

[51] Int. Cl.[4] ..... E03D 9/02

[52] U.S. Cl. ..... 4/231; 4/222; 4/222.1

[58] Field of Search ..... 4/231, 232, 228, 222

[56] References Cited

U.S. PATENT DOCUMENTS

| | | | |
|---|---|---|---|
| 4,143,431 | 3/1979 | Goncalves | 4/231 |
| 4,203,172 | 5/1980 | Goncalves | 4/231 |
| 4,254,513 | 3/1981 | Cretin et al. | 4/231 |

FOREIGN PATENT DOCUMENTS

| | | | |
|---|---|---|---|
| 2430486 | 3/1980 | France | 4/231 |
| 2435657 | 5/1980 | France | 4/231 |
| 3002833 | 7/1981 | Netherlands | 4/231 |
| 1164141 | 9/1969 | United Kingdom | 4/231 |

*Primary Examiner*—Henry K. Artis

*Attorney, Agent, or Firm*—Ernest G. Szoke; Nelson H. Littell, Jr.; Henry E. Millson, Jr.

[57] ABSTRACT

A basket for toilet bowl cleaning blocks consisting of a container designed to be arranged in the toilet bowl beneath its rim and attached to a fastening clip may be made in a closed, automatically fillable and child-proof design providing the container consists of two baskets held together solely by peripheral rings and each basket consists of several holding ribs integrally formed with the associated peripheral ring and extending substantially axially away from the peripheral ring and comprises an insertion funnel for the block of active material at its end face remote from the peripheral ring, this funnel being defined by the free ends of the holding ribs.

18 Claims, 2 Drawing Figures

BASKET FOR TOILET BOWL CLEANING BLOCKS

BACKGROUND OF THE INVENTION

This invention relates to a basket for toilet bowl cleaning blocks consisting of a container accommodating the particular block which is designed to be arranged in the toilet bowl beneath its rim and through which the water flows on flushing, the container being provided with a clip for fastening to the rim of the toilet bowl.

Products of this type are known as so-called toilet bowl cleaners and consist of a basket-like container accommodating a cleaning block which is generally extruded. Toilet bowl cleaners such as these may be placed against the side wall of the toilet bowl beneath its rim by means of a fastening clip corresponding in shape to the rim of the bowl. The toilet bowl block is activated, i.e. dissolved at its surface, by the stream of water which enters the bowl on flushing either through emptying of the cistern or through operation of the flush valve. Accordingly, cleaning or sanitizing solution is mixed with the water flowing through the container accommodating the block.

Containers or baskets for toilet bowl blocks are available in various designs. On the one hand, there are open containers which are designed primarily for refilling by the user. On the other hand, completely closed, generally non-reusable containers are also commercially available. In addition, containers of this type have to be child-proof in some European countries.

OBJECTS OF THE INVENTION

An object of the present invention is to provide a refillable child-proof container in the form of a basket for toilet bowl cleaning blocks.

A further object of the present invention is the development of a basket for at least one toilet bowl cleaning block consisting of a container designed to be arranged in a toilet bowl beneath its rim and through which water flows on flushing, said container having a clip for fastening to the rim of the toilet bowl, said container comprising two substantially identical baskets attached by a hinge and capable of being foldably, lockably attached together, each of said baskets comprising a ring having locking means capable of reciprocating with the ring having locking means of the other of said baskets whereby when folded about said hinge, said baskets are locked together, and resilent holding ribs extending substantially axially away from said ring, the free ends of said holding ribs terminating in the form of a ring forming a resiliently-opening block insertion funnel capable of receiving a toilet bowl cleaning block.

These and other objects of the invention will become more apparent as the description thereof proceeds.

THE DRAWINGS

DESCRIPTION OF THE INVENTION

Figure 1:
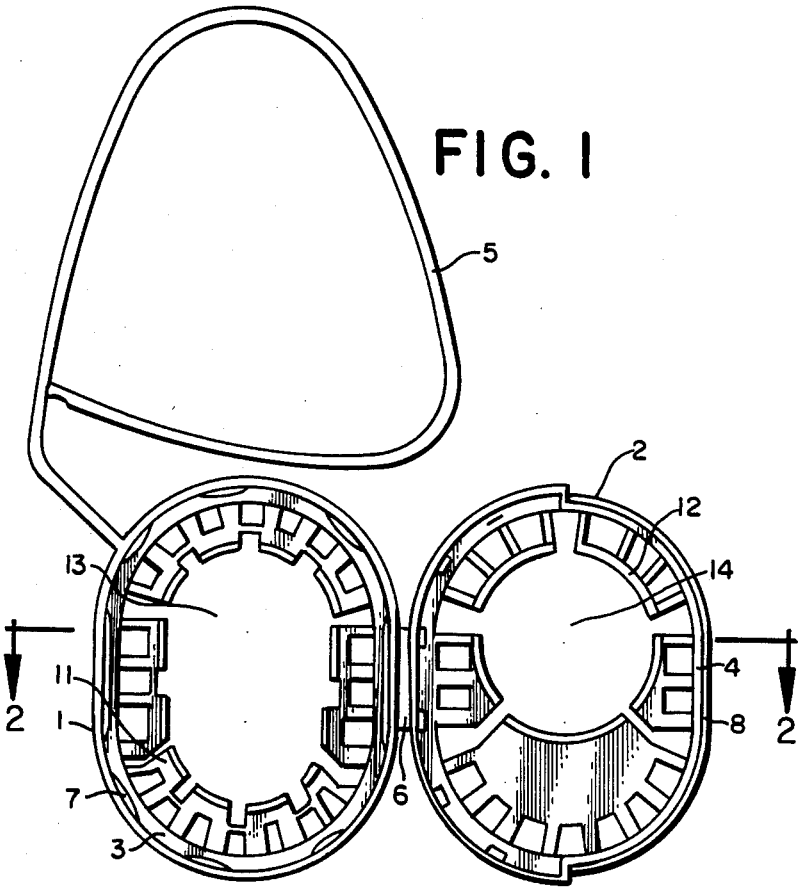
FIG. 1 is a plan view of the inside of the pair of baskets of the invention in the open position.

The container according to the invention is of a basically closed design which may be automatically filled and is readily refilled. According to the invention, this object is achieved in a basket for toilet bowl blocks comprising a container accommodating the particular block with a clip for attachment to the rim of the toilet bowl in that the container consists of a ring coupled to the clip with baskets adjoining its two end faces and in that each basket consists of several holding ribs integrally formed with the ring and extending substantially axially away from the ring and comprises a resiliently open block insertion funnel at its end face remote from the ring and defined by the free ends of the holding ribs.

More particularly, the present invention relates to a basket for at least one toilet bowl cleaning block consisting of a container designed to be arranged in a toilet bowl beneath its rim and through which water flows on flushing, said container having a clip for fastening to the rim of the toilet bowl, said container comprising two substantially identical baskets attached by a hinge and capable of being foldably, lockably attached together, each of said baskets comprising a ring having locking means capable of reciprocating with the ring having locking means of the other of said baskets whereby when folded about said hinge, said baskets are locked together, and resilent holding ribs extending substantially axially away from said ring, the free ends of said holding ribs terminating in a multiplicity of segments forming a resiliently-open block insertion funnel capable of receiving a toilet bowl cleaning block.

The hinge need not be employed and the baskets can be attached together by mating the same together. While the preferred embodiment utilizes two substantially identical baskets, only one of the baskets need have the holding ribs terminating in a multiplicity of segments.

Overall, the ribs of the basket-like container according to the invention are like a barrel in shape. The fact that the end faces of the holding ribs form a block insertion funnel and that several basket ribs at a time are preferably combined in segments enables a basically closed container to be filled and refilled. For filling, the particular half of the basket is radially spread open. After the block of active material has entered the basket, the basket ribs at the entrance close again so that the basket so to speak swallows the block.

For forming the basket and then filling it for the first time, it can be of advantage to form two rings designed to be axially fitted together. The two rings with their integrally formed baskets are joined by a film hinge and interlocked in child-proof manner by folding together in such a way that the basket-like container proper is obtained after the two rings have been folded together. By virtue of this construction, the basket-like container may be formed in one piece by injection molding, automatically filled with the block of active material by insertion into one of the rings and closed by folding and snapping the rings together. However, the container which, thus, is basically closed may be refilled through the insertion funnel at the holding ribs which are designed to spread elastically outwards.

An embodiment of the invention is described in detail in the following with reference to the accompanying drawings, wherein:

FIG. 1 is a plan view of the inside of the pair of baskets in open position.

Figure 2:
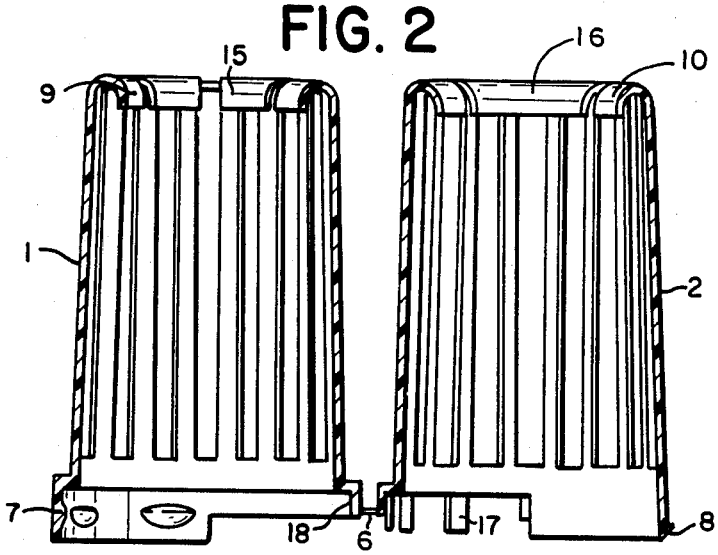
FIG. 2 is a side elevation, partly in section along line A—A of FIG. 1.

FIG. 2 is a side elevation, partly in section, of the pair of baskets, still in open position.

The basket-like container for toilet bowl blocks according to the invention which is shown in FIGS. 1 and 2 consists of a container which is formed from two baskets 1 and 2 having peripheral rings 3 and 4 and to which a fastening clip 5 is attached. The peripheral rings 3 and 4 are held together by a film hinge 6 and may be joined firmly together by folding about the hinge 6 and engaging the edges of the rings in one another behind lips or holding rims 7 and 8, preferably in such a way that the container is child-proof. This is accomplished in the customary manner by the elongated studs 17 extending from ring 4 of basket 2 and the recess 18 in ring 3 of basket 1.

The two baskets 1 and 2 consist of the associated peripheral rings 3 and 4 with integrally formed holding ribs 9 and 10. The holding ribs are preferably combined with one another in segments 11 and 12. The spring characteristic of the holding ribs 9, 10 or segments 11, 12 may be determined in advance by the geometry of the ribs, by the number of holding ribs 9, 10 to be combined to form segments 11, 12 and by the choice of material. The geometry is best such that the insertion holes 13, 14 at the end faces 15, 16 of the baskets 1, 2 are substantially circular but may be spread wide open by insertion of a block of active material and, finally after insertion, they will reassume their substantially relaxed form at least at the longitudinal ends or end faces 15 and 16.

Although the baskets 1, 2 do ot have to be circular in cross-section on the outside (for example, they may be substantially elliptical in cross-section), a certain symmetry is desirable for technical and aesthetic reasons. They are preferably shaped in such a way that a plane of symmetry extending axially of the rings 3, 4 and, for example, parallel to the pivot axis of the film hinge 6 is present.

The preceeding specific embodiments are illustrative of the practice of the invention. It is to be understood however, that other expedients known to those skilled in the art or disclosed herein may be employed without departing from the spirit of the invention or the scope of the appended claims.

We claim:

1. A basket for at least one toilet bowl cleaning block consisting of a container designed to be arranged in a toilet bowl beneath its rim and through which water flows on flushing, said container having a clip for fastening to the rim of the toilet bowl, said container comprising two substantially identical baskets attached by a hinge and capable of being foldably, lockably attached together, each of said baskets comprising a ring having locking means capable of reciprocating with the ring having locking means of the other of said baskets whereby when folded about said hinge, said baskets are locked together with one of said rings attached to said clip, and resilent holding ribs extending substantially axially away from said ring, the free ends of said holding ribs terminating in a multiplicity of segments forming a resiliently-open block insertion funnel capable of receiving a toilet bowl cleaning block.

2. The basket of claim 1 wherein said holding ribs are combined or formed integrally with one another in groups as segments in the peripheral direction of the block insertion funnel.

3. The basket of claim 1 wherein said baskets are locked together in a child-proof manner.

4. The basket of claim 2 wherein said baskets are locked together in a child-proof manner.

5. The basket of claim 1 wherein said basket rings are substantially elliptical.

6. The basket of claim 2 wherein said basket rings are substantially elliptical.

7. The basket of claim 4 wherein said basket rings are substantially elliptical.

8. The basket of claim 1 having a plane of symmetry extending axially relative to said rings and parallel to the pivot axis of the film hinge.

9. The basket of claim 2 having a plane of symmetry extending axially relative to said rings and parallel to the pivot axis of the film hinge.

10. The basket of claim 4 having a plane of symmetry extending axially relative to said rings and parallel to the pivot axis of the film hinge.

11. The basket of claim 7 having a plane of symmetry extending axially relative to said rings and parallel to the pivot axis of the film hinge.

12. The basket of claim 1 wherein, in the relaxed state, said insertion funnel and the adjoining holding space of the container which is opened out by said holding ribs are substantially circular in cross-section.

13. The basket of claim 2 wherein, in the relaxed state, said insertion funnel and the adjoining holding space of the container which is opened out by said holding ribs are substantially circular in cross-section.

14. The basket of claim 4 wherein, in the relaxed state, said insertion funnel and the adjoining holding space of the container which is opened out by said holding ribs are substantially circular in cross-section.

15. The basket of claim 7 wherein, in the relaxed state, said insertion funnel and the adjoining holding space of the container which is opened out by said holding ribs are substantially circular in cross-section.

16. The basket of claim 11 wherein, in the relaxed state, said insertion funnel and the adjoining holding space of the container which is opened out by said holding ribs are substantially circular in cross-section.

17. A basket for at least one toilet bowl cleaning block consisting of a container designed to be arranged in a toilet bowl beneath its rim and through which water flows on flushing, said container having a clip for fastening to the rim of the toilet bowl, said container comprising two substantially identical baskets capable of being lockably attached together, each of said baskets comprising a ring having locking means capable of reciprocating with the ring having locking means of the other of said baskets whereby when mated together, said baskets are locked together with one of said rings attached to said clip, and resilent holding ribs extending substantially axially away from said ring, the free ends of said holding ribs in at least one of said baskets terminating in a multiplicity of segments forming a resiliently-open block insertion funnel capable of receiving a toilet bowl cleaning block.

18. A basket for at least one toilet bowl cleaning block consisting of a container designed to be arranged in a toilet bowl beneath its rim and through which water flows on flushing, said container having a clip for fastening to the rim of the toilet bowl, said container comprising two substantially identical baskets attached by a film hinge and capable of being foldably, lockably attached together, each of said baskets comprising a ring having locking means capable of reciprocating with the ring having locking means of the other of said baskets whereby when said rings are folded about said hinge, said baskets are locked together with one of said rings attached to said clip, said basket having a plane of symmetry extending axially relative to said rings and parallel to the pivot axis of the film hinge, and resilient holding ribs extending substantially axially away from said ring, the free ends of said holding ribs in at least one of said baskets are combined or formed integrally with one another terminating in a multiplicity of groups as segments forming a resiliently-open block insertion funnel and adjoining holding space, said segments being formed in the peripheral direction to the funnel and said funnel being capable of receiving a toilet bowl cleaning block, and in the relaxed state, said insertion funnel and the adjoining holding space of the container which is opened out by said holding ribs are substantially circular in cross section.

* * * * *